United States Patent [19]

Charles

[11] Patent Number: 4,976,229

[45] Date of Patent: Dec. 11, 1990

[54] ENGINE CAMSHAFT PHASING

[75] Inventor: Herbert N. Charles, Chatham, Canada

[73] Assignee: Siemens Automotive L.P., Troy, Mich.

[21] Appl. No.: 478,797

[22] Filed: Feb. 12, 1990

[51] Int. Cl.[5] ..... F01L 1/34

[52] U.S. Cl. ..... 123/90.17; 123/90.31

[58] Field of Search ..... 123/90.15, 90.17, 90.31

[56] References Cited

U.S. PATENT DOCUMENTS

| | | | |
|---|---|---|---|
| 4,421,074 | 12/1983 | Garcea et al. | 123/90.15 |
| 4,463,712 | 8/1984 | Stojek et al. | 123/90.31 |
| 4,535,731 | 8/1985 | Banfi | 123/90.17 |
| 4,754,727 | 7/1988 | Hampton | 123/90.17 |
| 4,811,698 | 3/1989 | Akasaka et al. | 123/90.17 |
| 4,856,465 | 8/1989 | Denz et al. | 123/90.17 |
| 4,889,086 | 12/1989 | Scapecchi | 123/90.31 |

FOREIGN PATENT DOCUMENTS

| | | | |
|---|---|---|---|
| 335083 | 10/1989 | European Pat. Off. | 123/90.31 |
| 3111 | 1/1987 | Japan | 123/90.17 |
| 2152193 | 7/1985 | United Kingdom | 123/90.17 |

*Primary Examiner*—Charles J. Myhre
*Assistant Examiner*—Weilun Lo
*Attorney, Agent, or Firm*—George L. Boller; Russel C. Wells

[57] ABSTRACT

A phase adjustment mechanism for setting the phase of the engine camshaft relative to that of the crankshaft. The operative coupling of the crankshaft to the camshaft is via two sets of splines, one set having pitch different from that of the other set. A spline engagement ring contains a spline of one set on its O.D. and a spline of the other set on its I.D. The axial positioning of the ring controls the relative phasing and is accomplished by a screw and nut mechanism with the nut being operated by a worm drive that is under the control of the engine ECU.

10 Claims, 1 Drawing Sheet

ENGINE CAMSHAFT PHASING

BACKGROUND AND SUMMARY OF THE INVENTION

A potentially beneficial feature for an internal combustion engine is the ability to change the phasing of the engine's camshaft(s) relative to that of the engine's crankshaft for the purpose of changing the phasing of the operation of the engine's intake and/or exhaust valves, and a number of such phase adjustment mechanisms have heretofore been proposed. When a camshaft phase adjustment mechanism is of the electromechanical type, it can be placed under the jurisdiction of an electronic control system for the engine so that an electronic command signal from the control system to the electromechanical mechanism sets the relative phasing of the camshaft(s) to a desired setting within a range of relative phases. Changes in the command signal produce corresponding changes in the relative phasing.

When the engine is used as a powerplant for a motor vehicle, it is especially important for the phasing mechanism to be compact and economical, in addition to being accurate, durable, and responsive. The present invention is directed to a mechanism that possesses these attributes. Further details will be seen in the ensuing description and claims. The detailed description will be given with reference to an accompanying drawing which illustrates the best mode contemplated at the present time in carrying out the invention.

DESCRIPTION OF THE PREFERRED EMBODIMENT

Figure 1:
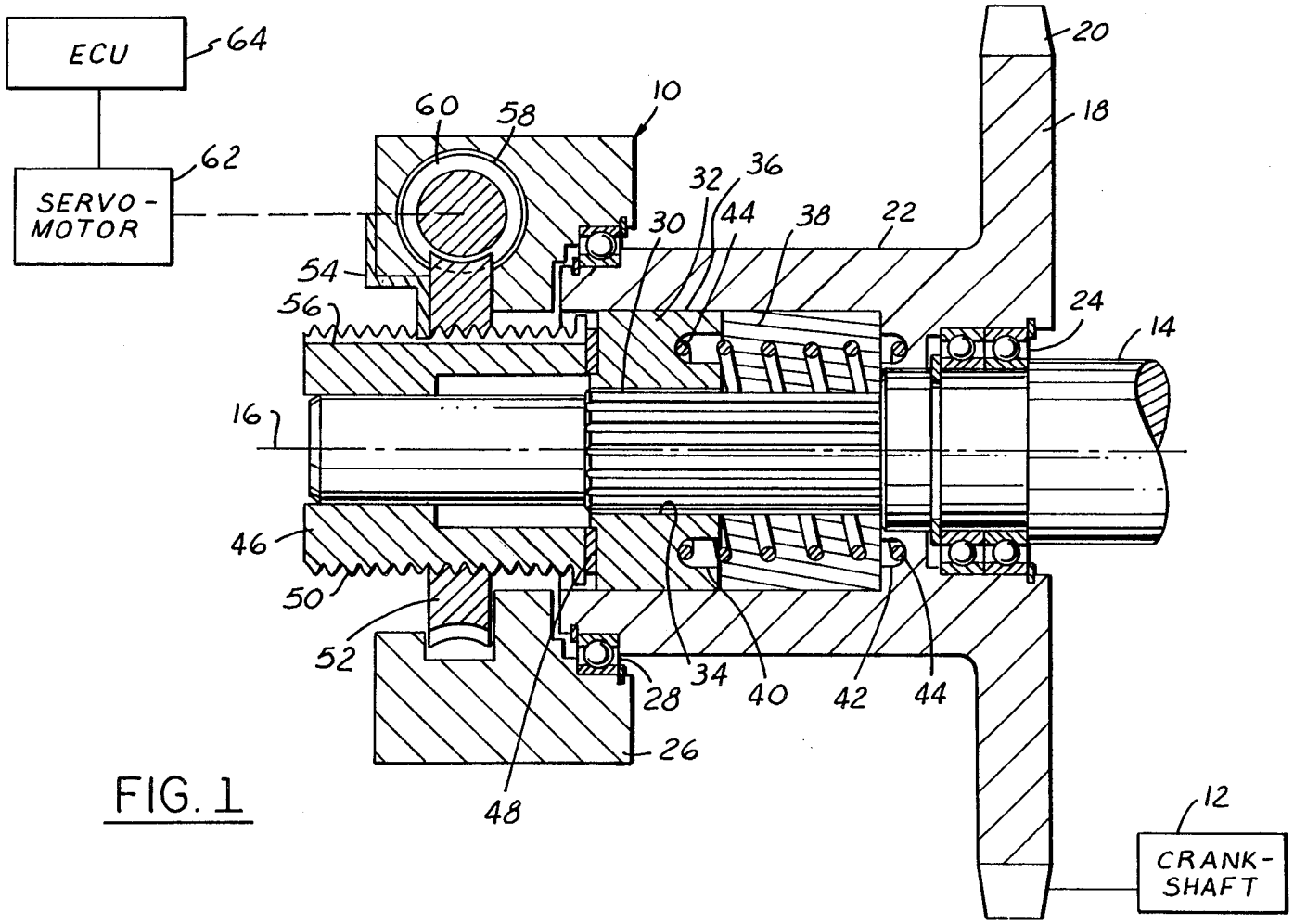
FIG. 1 is a longitudinal view, partly in section, and partly schematic, illustrating a presently preferred embodiment of the invention.

An exemplary embodiment of phasing mechanism 10 is illustrated in coupling relationship between an engine crankshaft 12 and an engine camshaft 14. An end portion of camshaft 14, whose axis is designated by the numeral 16, is portrayed, while crankshaft 12 is represented only schematically.

Mechanism 10 comprises a rotary input member 18 that is arranged coaxial with axis 16. Member 18 comprises a circular sprocket 20 that is coupled to crankshaft 12 by any suitable means such as an endless chain (not shown). Member 18 further comprises a tubular shaft portion 22 which is journaled on camshaft 14 by a bearing means 24 and on a body portion 26 by a bearing means 28. Body portion 26 is fixedly mounted on the engine in any secure manner (not shown).

Camshaft 14 comprises a spline section 30. A spline engagement ring 32 is disposed on spline section 30 coaxial with camshaft 14. The spline engagement ring comprises an internal spline 34 that is in mesh with spline section 30, and an external spline 36 that is in mesh with an internal spline 38 of shaft portion 22 .of input member 10. The set of splines 30, 34 are straight splines, while the set of splines 36, 38 are spiral splines.

Spline engagement ring 32 comprises a blind circular annular slot 40 that is open at one axial end of the spline engagement ring. A circular annular groove 42 is provided in an internal shoulder of member 18 in juxtaposition to the open axial end of slot 40. Slot 40 and groove 42 are of the same diameter, but slot 40 is noticeably deeper. One end of a helical compression spring 44 seats in groove 42 while the other end of the spring seats in slot 40. This arrangement serves to forcefully urge ring 32 axially away from groove 42.

The extent to which ring 32 is actually axially positioned away from groove 42 is established by the axial position of a mandrel member 46 that is coaxially disposed around the distal end portion of the camshaft that lies axially beyond spline section 30. Spring 44 functions to forcefully urge ring 32 in the axial direction away from groove 42 such that the axial end of ring 32 that faces mandrel member 46 is urged against a thrush washer 48 that is disposed between ring 32 and mandrel member 46.

Mandrel member 46 has an external screw thread 50 on which a nut 52 is threaded. Nut 52 is constrained on body 26 against axial displacement by a means that includes a retainer ring and mandrel key 54 fastened to body 26. Key 54 also serves to prevent mandrel member 46 from rotating by lodging in an axial keyway 56 formed in the mandrel member. Nut 52 can however rotate about its own axis, and so when such rotation occurs, mandrel member 46 is axially displaced. Displacement of mandrel member 46 in one direction causes ring 32 to be axially displaced in that same one direction, while displacement in the other direction causes ring 32 to also be displaced in that same other direction. The drawing Fig. shows ring 32 essentially at the left hand limit of its travel within member 18. Rotation of nut 52 in the sense that produces mandrel displacement in the direction out of member 18 enables spring 44 to displace ring 32 in the same direction and in a like amount; reversal of the nut's rotation reverses the displacement of the mandrel member, and hence of the ring in like amount, causing increasing spring compression.

The effect of the difference in pitch between the two sets of splines comes into play as ring 32 is axially displaced. Specifically, the effect is to create a phase change between input member 18 and camshaft 14. This then is how the mechanism basically functions. There is also however an especially convenient way for operating nut 52, and this is by use of a worm drive 58. A worm 60 is arranged on body 26 with its axis generally tangent to nut 52. The radially outer surface of the nut is shaped with suitable teeth 61 that mesh with worm 60. The worm is driven by a servo-motor 62 and can rotate in either direction to produce corresponding rotation of the nut. The servo-motor is under the control of the engine ECU 64.

Thus there has been described an improvement in the adjustable phasing of an engine camshaft. While a presently preferred embodiment of the invention has been illustrated and described, it is to be understood that principles of the invention are applicable to other equivalent embodiments as defined by the following claims.

What is claimed is:

1. In an internal combustion engine having a crankshaft that is operated by one or more reciprocal cylinder pistons, a camshaft that is driven by the crankshaft to operate one or more cylinder valves, and an electromechanical phasing mechanism for setting the phase of the camshaft relative to that of the crankshaft within a range of relative phases to obtain a desired phasing of cylinder valve operation relative to that of the crankshaft, the improvement in said phasing mechanism which comprises an input member that is driven by the crankshaft to rotate about the camshaft axis, a ring that is coaxial with said input member and couples the rotation of said input member to the crankshaft, said ring having a radially outer spline and a radially inner spline, one of said splines being in mesh with a mating spline on said input member to form a first set of mating splines and the other of said ring's splines being in mesh with a mating spline on the camshaft to form a second set of mating splines, said first and said second sets of mating splines having different pitches, and means for setting the axial position of said ring relative to the camshaft and to said input member over a range of axial positions to cause, via the actions of said first and second mating spline sets, the phase of the camshaft to be set to a desired relationship to that of said input member, and hence to that of the camshaft, within said range of relative phases, in which said means for setting the axial position of said ring relative to the camshaft and to said input member comprises the combination of a mandrel and a spring that are arranged to axially capture said ring, said mandrel being positionable along the camshaft axis.

2. The improvement set forth in claim 1 in which said radially outer spline of said ring and the mating spline on said input member are spiral, and said radially inner spline of said ring and the mating spline on said cam shaft are straight.

3. The improvement set forth in claim 1 in which one of said sets of splines is straight and the other of said sets of splines is spiral.

4. The improvement set forth in claim 1 in which said mandrel comprises a screw thread that is coaxial with the camshaft axis, and that is engaged by a complementary screw thread on a positioning member that operates to axially position said mandrel via the action of said screw threads.

5. The improvement set forth in claim 4 in which said mandrel has its screw thread on a radially outer surface thereof and said positioning member is a nut whose radially inner surface contains said complementary screw thread.

6. The improvement set forth in claim 5 in which said nut is operated by a worm drive whose axis lies transverse to that of the camshaft.

7. The improvement set forth in claim 1 in which said ring and said input member contain respective seats that seat respective end portions of said spring.

8. In an internal combustion engine having a crankshaft that is operated by one or more reciprocal cylinder pistons, a crankshaft that is driven by the crankshaft to operate one or more cylinder valves, and an electromechanical phasing mechanism for setting the phase of the crankshaft relative to that of the crankshaft with a range of relative phases to obtain a desired phasing of cylinder valve operation relative to that of the crankshaft, the improvement in said phasing mechanism which comprises an input member that is driven by the crankshaft to rotate about the camshaft axis, a ring that is coaxial with said input member and couples the rotation of said input member to the camshaft, said ring having a radially outer spline and a radially inner spline, one of said splines being in mesh with a mating spline on said input member to form a first set of mating splines and the other of said ring's splines being in mesh with a mating spline on the camshaft to form a second set of mating splines, said first and said second sets of mating splines having different pitches, and means for setting the axial position of said ring relative to the camshaft and to said input member over a range of axial positions to cause, via the actions of said first and second mating spline sets, the phase of the camshaft to be set to a desired relationship to that of said input member, and hence to that of the camshaft, within said range of relative phases in which said means for setting the axial position of said ring relative to the camshaft and to said input member comprises a positioning member that is axially positionable along the camshaft axis, said positioning member comprising an external screw thread, a threaded nut that is threaded onto said positioning member's screw thread and is constrained against axial displacement, and a worm drive that rotates said nut to cause axial positioning of said positioning member.

9. In an internal combustion engine having a crankshaft that is operated by one or more reciprocal cylinder pistons, a camshaft that is driven by the crankshaft to operate one or more cylinder valves, and an electromechanical phasing mechanism for setting the phase of the camshaft relative to that of the crankshaft within a range of relative phases to obtain a desired phasing of cylinder valve operation relative to that of the crankshaft, the improvement in said phasing mechanism which comprises an input member that is driven by the crankshaft to rotate about the camshaft axis, phasing means coupling the rotation of said input member to the camshaft and coaxially positionable with respect to said input member and the camshaft in a manner that sets a desired phasing relationship between the camshaft and said input member within a phasing range, and means for setting the coaxial position of said phasing means relative to the camshaft and to said input member over a range of axial positions to cause the phase of the camshaft to be in a desired relationship to that of said input member within said range of relative phases, said means for setting the coaxial positioning of said phasing means comprising a positioning member that is coaxial with said camshaft and is caused to bear axially against said phasing means, and means for effectuating the coaxial positioning of said positioning member by rotation thereof comprising a worm drive.

10. The improvement set forth in claim 9 in which said positioning member comprises an external screw thread, said means for effectuating the coaxial positioning of said positioning member comprising a nut threaded onto said external screw thread, and said worm drive tangentially engaging said nut.

* * * * *